United States Patent [19]

Emenaker et al.

[11] Patent Number: 4,932,797

[45] Date of Patent: Jun. 12, 1990

[54] RESETTABLE LOCKING PLATEN GAP ADJUSTMENT MECHANISM

[75] Inventors: Leo J. Emenaker, El Segundo; Gordon B. Barrus, San Juan Capistrano, both of Calif.

[73] Assignee: Printronix, Inc., Irvine, Calif.

[21] Appl. No.: 208,573

[22] Filed: Jun. 17, 1988

[51] Int. Cl.[5] ..... B41J 11/20

[52] U.S. Cl. ..... 400/56; 400/649

[58] Field of Search ..... 400/55–59, 400/649

[56] References Cited

U.S. PATENT DOCUMENTS

| | | | |
|---|---|---|---|
| 3,643,772 | 2/1972 | Kittel et al. | 400/57 |
| 3,941,051 | 3/1976 | Barrus et al. | 101/93.04 |
| 4,023,662 | 5/1977 | Perucca | 400/57 |
| 4,086,997 | 5/1978 | Wu | 400/57 |
| 4,178,106 | 12/1979 | Mailer et al. | 400/57 |
| 4,189,244 | 2/1980 | Harrison | 400/59 |
| 4,359,289 | 11/1982 | Barrus et al. | 400/322 |
| 4,365,900 | 12/1982 | Gottsmann et al. | 400/57 |
| 4,395,145 | 7/1983 | Giacone et al. | 400/59 |

FOREIGN PATENT DOCUMENTS

| | | | |
|---|---|---|---|
| 701785 | 1/1966 | Canada | 400/59 |
| 49286 | 5/1981 | Japan | 400/59 |
| 98378 | 6/1982 | Japan | 400/58 |
| 207669 | 9/1987 | Japan | 400/59 |

*Primary Examiner*—Edgar S. Burr
*Assistant Examiner*—Joseph R. Keating

[57] ABSTRACT

In a printer in which a plurality of hammers mounted along the length of an elongated hammerbank are selectively fired as the hammerbank is reciprocated relative to an elongated platen to impact a length of ink ribbon against at least one length of print paper supported by the platen to effect printing in dot matrix fashion, the platen being rotatable about an axis of rotation to vary the size of a platen gap between the plurality of hammers and the platen, a mechanism is provided for positively locking the platen in any one of a succession of different rotational positions to provide locking platen gap adjustment. The Positions are identified in order to facilitate resetting of the platen to a desired gap size. The mechanism includes a rotatable knurled thumbknob having mounted thereon a cam having a succession of eccentric or radially varying detents in an outer surface thereof which receives the end of a pivotally mounted, spring-biased lever. Manual rotation of the thumbknob gradually rotates the lever as the end of the lever is positively positioned in each of the succession of detents. An opposite end of the lever engages a platen handle which is coupled to the platen and which is spring-biased to maintain engagement of the handle with the lever.

9 Claims, 3 Drawing Sheets

RESETTABLE LOCKING PLATEN GAP ADJUSTMENT MECHANISM

BACKGROUND OF THE INVENTION

1. Field of the Invention

The present invention relates to printers in which a platen gap formed between an impact printing member and a platen is varied in size to accommodate different forms thicknesses, and more particularly to printers in which a platen is rotated about an axis to adjust the size of the platen gap.

2. History of the Prior Art

Printers in which a platen gap must be adjusted to accommodate different forms thicknesses are known in the art. An example of such a printer is provided by U.S. Pat. No. 3,941,051 of Barrus et al., PRINTER SYSTEM issued Mar. 2, 1976 and commonly assigned with the present application.

The Barrus et al. patent describes a dot matrix line printer having an elongated hammerbank driven in reciprocating, bi-directional fashion by a cam drive assembly. A ribbon deck mounted within the printer adjacent the hammerbank disposes a length of ink ribbon between a plurality of hammer springs mounted in spaced-apart, parallel fashion along the length of the hammerbank and an adjacent platen. One or more lengths of print paper are disposed between the length of ink ribbon and the platen and are stepped through the print station defined by the space between the hammerbank and the platen by a tractor drive arrangement.

The printer described in the Barrus et al. patent performs printing in dot matrix fashion. As the hammerbank is reciprocated back and forth across the print paper, various ones of the hammer springs along the length of the hammerbank are released or "fired" from the spring-loaded retracted positions in which they are normally held, using associated magnetic hammer actuators. As each hammer spring is fired, an upper free end thereof which mounts a dot printing impact tip thereon flies forward out of the retracted position so that the dot printing impact tip impacts the length of ink ribbon against the print paper to print a dot. The hammer spring then rebounds into the retracted position. Each of the magnetic hammer actuators includes a permanent magnet coupled to the upper free end of an associated one of the hammer springs through a pole piece. The permanent magnet normally holds the hammer spring in the spring-loaded retracted position in readiness for firing. The magnetic hammer actuator also includes a magnetic coil surrounding the pole piece and operative, when momentarily energized, to overcome the effects of the permanent magnet and release the hammer spring to print a dot on the print paper.

In dot matrix impact printers of the type described in the Barrus et al. patent, paper forms having different thicknesses are disposed within the print station where they are supported by the platen. The paper form may comprise a single thickness of print paper or it may comprise a multi-paper form with carbons interposed between adjacent layers of paper. The thickness of a given length of paper may also vary depending on the type and quality of the paper.

Because of the different forms thicknesses, the platen gap within the print station which is defined by the distance between the hammer springs and the platen and which is generally uniform in size along the length of the hammerbank must be variable to accommodate the different forms thicknesses. It has been found that the size of the platen gap is quite important, and even minor variations in the platen gap for a given forms thickness can seriously affect print quality.

In printers of the type described in the Barrus et al. patent, the platen is typically mounted for rotation about an axis, with rotation of the platen being provided by a manually manipulated platen handle coupled to one end of the platen. As the platen handle is manually rotated to rotate the platen, the paper supporting surface of the platen within the print station varies in the distance thereof from the axis of rotation of the platen in eccentric fashion so as to adjust the size of the platen gap. Once the platen gap is adjusted, the friction of the platen mounting mechanism tends to maintain the angular position of the platen and therefor the size of the platen gap defined thereby. To facilitate positioning of the platen handle to achieve the desired platen gap, the platen handle is typically provided with a pointer and is positioned next to a scale. As the platen handle is rotated the pointer thereon resides at different locations along the scale designating the proper platen gap for different forms thicknesses.

Conventional platen gap adjusting arrangements are typically somewhat deficient in their ability to provide precision platen gap setting and maintenance of the setting thereafter. Due to the frictional nature of the positioning typically used, gap size can change or "creep" due to such things as vibration of the printer and paper drag on the platen as the paper is continuously advanced over the platen by the tractor drives. The pointer and scale arrangement used for setting and thereafter resetting the platen gap is not always accurate. Quite often, trial and error are required to obtain an accurate initial setting, which process often must be repeated to reset the gap later. Also, when the printer is shipped, it is usually necessary to place a constraining device in the platen gap to prevent creep of the platen into a position in which the platen can damage the hammerbank.

Accordingly, it would be desirable to provide a mechanism for precisely and accurately selecting the proper platen gap with the gap thereafter being maintained in spite of printer vibrations, paper drag and the like. It would also be desirable to provide a mechanism for precisely and accurately resetting the platen gap to a desired size after the gap has been changed.

BRIEF DESCRIPTION OF THE INVENTION

The foregoing and other features and advantages are accomplished in accordance with the invention by a resettable locking platen gap adjustment mechanism which provides positive definition of a succession of different rotational positions of the platen and locking of the mechanism in any one of those positions so that platen gap creep or variation cannot occur. A desired platen gap can be initially selected without going through a trial and error process or an exercise of judgment. Thereafter, the mechanism is easily reset to the desired platen gap after a change of ribbon or other interruption, again without going through a trial and error process or otherwise having to exercise judgment.

Resettable locking platen gap adjustment mechanisms in accordance with the invention utilize a succession of detents, each of which defines a slightly different angular position of the platen. A resiliently biased arrangement is then locked into one of the detents to provide a selected platen gap which cannot vary thereafter until the apparatus is positioned in a different detent. The presence of the separate detents facilitates resetting to a desired platen gap after a change of ribbon or other interruption.

In a preferred arrangement of a resettable locking platen gap adjustment mechanism in accordance with the invention, the mechanism is comprised of a knurled thumbknob which is manually rotatable about an axis of rotation and which has a cam mounted on the side thereof. The cam is provided with an outer surface arranged into a succession of detents which vary in eccentric fashion such that the radial distance of each detent from the axis of rotation of the thumbknob incrementally decreases.

A platen handle stop lever is pivotally mounted for rotation about a central portion thereof and has a first end thereof engaged in one of the detents in the outer surface of the cam. A lever spring coupled between a fixed point on the printer frame and a location on the lever between the pivot axis and a second end of the lever opposite the first end resiliently biases the lever in a direction of rotation so as to maintain the first end of the lever positively seated in one of the detents in the cam.

An opposite second end of the lever determines the rotational position of the platen by means of a platen handle which is coupled to the platen and which is maintained in contact with the second end of the lever by an overcenter spring. The overcenter spring is coupled between a fixed reference point on the printer and a location on the platen handle which is spaced-apart from the axis of rotation of the platen handle and the platen. The overcenter spring normally biases the platen handle in a direction of rotation which maintains the platen handle engaged with the second end of the lever. However, when the platen handle is rotated in a direction away from the lever by a sufficient amount, the location at which the overcenter spring is attached to the platen handle passes to the other side of the axis of rotation of the platen handle so as to pull the platen handle into an open or paper load position. Following paper loading the platen handle may be rotated back into contact with the second end of the lever so that the overcenter spring maintains the platen handle engaged with the second end of the lever.

BRIEF DESCRIPTION OF THE DRAWINGS

A better understanding of the invention may be had by reference to the following description, taken in conjunction with the accompanying drawings, in which.

DETAILED DESCRIPTION

Figure 1:
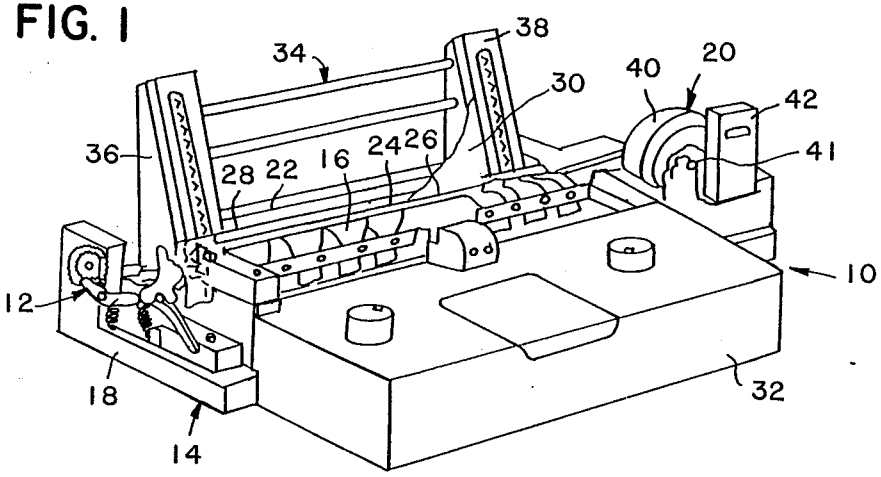
FIG. 1 is a perspective view of the major portion of a printer having a resettable locking platen gap adjustment mechanism in accordance with the invention.

FIG. 1 depicts a printer 10 having a resettable locking platen gap adjustment mechanism 12 in accordance with the invention. The printer 10 includes a shuttle assembly 14 having a hammerbank 16 mounted within a shuttle base 18 so as to undergo reciprocating movement in response to a cam drive assembly 20. The shuttle assembly 14 includes an elongated platen 22 mounted so as to be rotatable within the shuttle base 18. The hammerbank 16 has a cover assembly 24 mounted thereon and facing the platen 22.

A print station 26 between the cover assembly 24 of the hammerbank 16 and the platen 22 is characterized by a platen gap 28. The platen gap 28 is of uniform size along the length of the elongated hammerbank 16 and the elongated platen 22. As described in detail hereafter, the resettable locking platen gap adjustment mechanism 12 in accordance with the invention provides for rotation of the platen 22 to a desired angular position to provide a desired platen gap size, whereupon the platen 22 is thereafter locked in that position to prevent inadvertent changing of the platen gap 28. Thereafter, the platen 22 can easily be reset to the desired platen gap size after a change of ribbon or other interruption.

As described hereafter, the hammerbank 16 is provided with a plurality of hammer springs mounted along the length thereof adjacent the cover assembly 24. During the reciprocated movement of the hammerbank 16 relative to the platen 22 as provided by the cam drive assembly 20, the hammer springs are selectively released or fired such that they impact a length of print paper 30 through a length of ink ribbon (not shown in FIG. 1) provided by a ribbon deck 32. The print paper 30 is advanced through the platen gap 28 of the print station 26 by a tractor drive arrangement 34 which is comprised of a pair of opposite tractor drives 36 and 38. The tractor drives 36 and 38 engage spaced perforations in the opposite edges of the print paper 30 and increment the print paper 30 upwardly through the print station 26 in conventional fashion.

The cam drive assembly 20 includes a driven flywheel 40 having a cam 41 mounted thereon. In conventional fashion, the driven flywheel 40 rotates the cam 41 so as to drive the hammerbank 16 in reciprocating fashion via a cam follower assembly mounted on the hammerbank 16 and engaging the cam 41. A counterbalancing assembly 42 is also coupled to the cam 41 to be driven in an opposite, out-of-phase relationship to the hammerbank 16 so that vibration of the printer 10 due to the reciprocating motion of the hammerbank 16 is minimized.

With the exception of the resettable locking platen gap adjustment mechanism 12 in accordance with the invention the other portions of the printer 10 which are shown in FIG. 1 and hereafter are described in greater detail in a copending application of Norman E. Farb et al., Ser. No. 069,486, filed Jul. 1, 1987, entitled "PRINTER HAVING INTERCHANGEABLE SHUTTLE ASSEMBLY" and commonly assigned with the present application.

The print paper 30 in FIG. 1 is referred to as a length of print paper by way of example only. In actuality the element 30 can comprise one or more forms of stacked papers, some with interposed carbons, such that the thickness of the element 30 can vary greatly. It is such variations in thickness which require adjustment of the platen gap 28, and this is achieved in a superior manner by the locking platen gap adjustment mechanism 12 in accordance with the invention.

Figure 2:
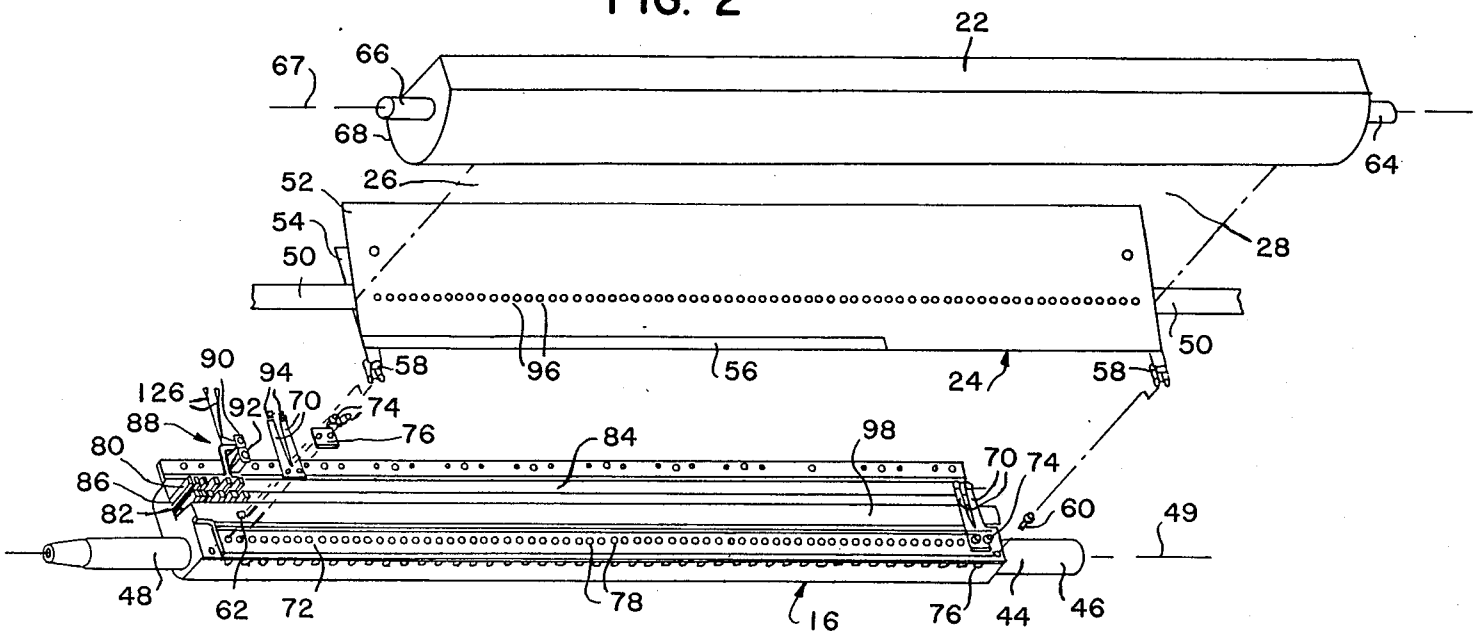
FIG. 2 is an exploded perspective view of the hammerbank with cover assembly and the platen forming a portion of the shuttle assembly of the printer of FIG. 1 and illustrating the nature of the platen gap.

FIG. 2 is a exploded perspective view showing the hammerbank 16, the cover assembly 24 and the elongated platen 22. The hammerbank 16 includes a single, integrally formed shaft 44 mounted therein and extending along the length thereof. The opposite ends of the shaft 44, which is of hollow, generally cylindrical configuration, extend outwardly from the opposite ends of the hammerbank 16 to provide a pair of opposite shaft lengths 46 and 48 external to the hammerbank 16. As described hereafter, the shaft lengths 46 and 48 are received within linear sleeve bearings mounted in the shuttle base 18 to permit reciprocating motion of the hammerbank 16 along an axis of elongation 49 of the shaft 44. A cam follower assembly (not shown in FIG. 2) is mounted on the end of the shaft length 48 so as to engage the cam 41 within the cam drive assembly 20 shown in FIG. 1 to drive the hammerbank 16 in reciprocating fashion.

The cover assembly 24 which is mounted on the hammerbank 16 receives a length of ink ribbon 50 therein from the ribbon deck 32. The cover assembly 24, which is of folded configuration so as to have front and rear portions 52 and 54 thereof with the length of ink ribbon 50 disposed therebetween, has a lower edge 56 thereof secured to the hammerbank 16 along the length of the hammerbank 16. The cover assembly 24 is secured to the hammerbank 16 along the lower edge 56 thereof such as by fasteners 58 coupled to the opposite ends of the lower edge 56 and secured to the opposite ends of the hammerbank 16 by bolts 60 and 62.

The front portion 52 of the cover assembly 24 faces and forms the platen gap 28 with the platen 22. The print paper 30 or other forms of variable thickness must pass through the platen gap 28. The platen gap 28 must be just slightly larger than the form thickness so as to permit free passage of the form therethrough while at the same time maintaining relatively close juxtapositioning of the hammerbank 16 to the opposing face of the platen 22 so that printing is closely controlled and print quality is thereby optimized.

The platen 22 has a pair of shafts 64 and 66 coupled to the opposite ends thereof. The shafts 64 and 66 lie along a common axis 67 which is parallel to the axis of elongation 49 of the shaft 44 of the hammerbank 16. As described hereafter, the shafts 64 and 66 mount the platen 22 for rotation about the common axis 67 thereof. The platen 22 has a front surface 68 thereof which faces the front portion 52 of the cover assembly 24 on the hammerbank 16 and which defines one side of the platen gap 28. The front surface 68 is of variable distance from the common axis 67 of the shafts 64 and 66 along the height of the surface 68. Consequently, when the platen 22 rotates about the axis 67, different vertical portions of the front surface 68 of the platen 22 having differing distances from the common axis 67 of the shafts 64 and 66 are presented at the platen gap 28, and the size of the platen gap 28 is thereby varied.

In the present example, the hammerbank 16 has a total of sixty six hammer springs 70 mounted along the length thereof in spaced-apart, parallel fashion. Only four of the hammer springs 70 are shown in FIG. 2 for ease of illustration. The hammer springs 70 are mounted along a hammer spring mounting surface 72 extending along the length of the hammerbank 16. Each hammer spring 70 has a lower end thereof secured to the mounting surface 72 by a screw 74 which extends through a mounting plate 76, through a lower end of the hammer spring 70, and into a screw hole 78 which extends into the hammerbank 16 from the mounting surface 72.

Associated with each hammer spring 70 is a different pair of pole pieces 80 and 82 mounted within a groove 84 extending along an upper portion of the hammerbank 16 spaced-apart from and generally parallel to the hammer spring mounting surface 72. The pole pieces 80 and 82 form part of a magnetic hammer actuator for the hammer spring 70. Pole pieces 80 and 82 have a permanent magnet 86 disposed therebetween within the groove 84. A coil assembly 88 forming a part of the magnetic hammer actuator includes a first magnetic coil 90 mounted on the first pole piece 80 and a second magnetic coil 92 mounted on the second pole piece 82. The first and second magnetic coils 90 and 92 are disposed on the pole pieces 80 and 82 outside of the groove 84 and adjacent an upper free end of the hammer spring 70.

The hammer springs 70 are made of resilient magnetic material such as spring steel. Each hammer spring 70 is normally held in a slightly flexed, spring-loaded retracted position against the tips of the pole pieces 80 and 82 by action of the permanent magnet 86 which completes a magnetic path through the pole pieces 80 and 82 and an adjacent upper portion of the hammer spring 70. Each of the hammer springs 70 has a dot printing impact tip 94 mounted thereon at the upper free end of the hammer spring 70. Each of the impact tips 94 is disposed adjacent a different pair of apertures 96 in the front and rear portions 52 and 54 of the cover assembly 24.

During printing and as the hammerbank 16 is reciprocated relative to the platen 22 the various hammer springs 70 are selectively released or fired to print dots on the length of print paper 30 supported by the platen 22. Release of each hammer spring 70 is accomplished by energizing the first and second coils 90 and 92 of the coil assembly 88 associated therewith long enough to overcome the magnetic holding force of the permanent magnet 86 and send the upper free end of the hammer spring 70 flying away from the pole pieces 80 and 82. As the hammer spring 70 moves away from the pole pieces 80 and 82, the impact tip 94 extends through the associated pair of apertures 96 in the cover assembly 24 to impact the length of ink ribbon 50 disposed between the front and rear portions 52 and 54 of the cover assembly 24 against the length of print paper 30 which is supported by the platen 22. Following impact, the hammer spring 70 rebounds back into the retracted position against the pole pieces 80 and 82 where it remains in the retracted position in preparation for the next release of the hammer spring 70. Movement of the hammer spring 70 into the retracted position is damped by a Kapton strip 98 extending along the length of the hammerbank 16 between the hammer spring mounting surface 72 and the groove 84 containing the pole pieces 80 and 82. The Kapton strip 98 which is disposed adjacent intermediate portions of the hammer springs 70 is comprised of several layers of Kapton sandwiched together to form the strip 98.

Figure 3:
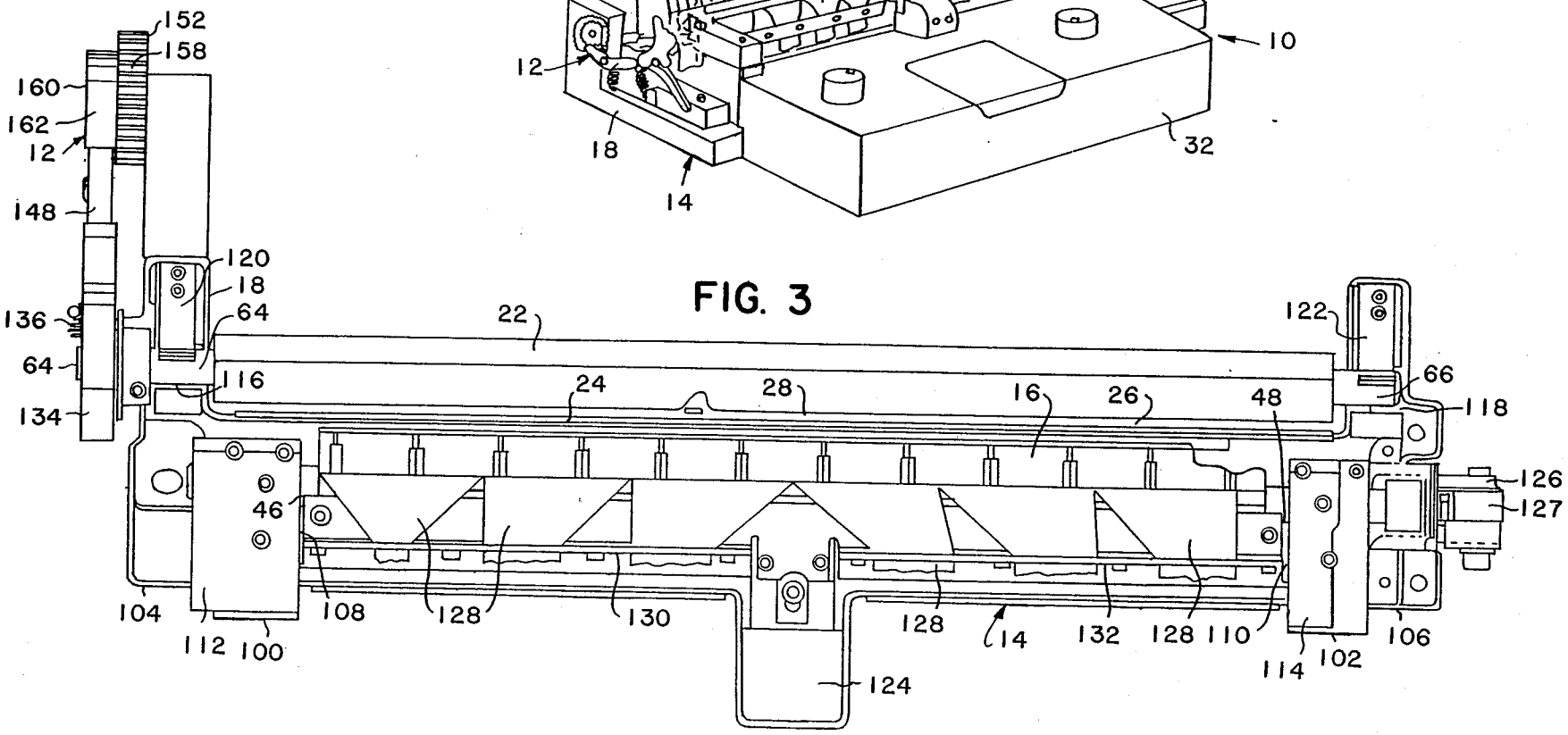
FIG. 3 is a top view of the shuttle assembly of the printer of FIG. 1 with includes the resettable locking platen gap adjustment mechanism.

FIG. 3 is a top view of the shuttle assembly 14 which includes the resettable locking platen gap adjustment mechanism 12 in accordance with the invention. The shuttle base 18 is configured to define bearing blocks 100 and 102 at left-hand and right-hand ends 104 and 106 thereof respectively. The bearing block 100 and 102 have recesses therein for receiving linear sleeve bearings 108 and 110 respectively. The opposite lengths 46 and 48 of the shaft 44 within the hammerbank 16 are received within the linear sleeve bearings 108 and 110 respectively to permit reciprocating movement of the hammerbank 16 relative to the shuttle base 18. The linear sleeve bearings 108 and 110 are held in place within the recesses in the bearing blocks 100 and 102 by bearing caps 112 and 114 respectively.

The shuttle base 18 is also configured to define a bearing surface 116 adjacent and behind the linear sleeve bearing 108 and a bearing surface 118 behind and adjacent the linear sleeve bearing 110. The bearing surfaces 116 and 118 are designed to receive the shafts 64 and 66 respectively at the opposite ends of the platen 22. The shafts 64 and 66 are held in place on the bearing surfaces 116 and 118 by clamping assemblies 120 and 122 respectively. The clamping assemblies 120 and 122 permit rotation of the shafts 64 and 66 thereon in order to vary the angular orientation of the platen 22 and thereby the size of the platen gap 28.

The shuttle base 18 further includes an anti-rotation assembly 124. The anti-rotation assembly 124 prevents rotation of the hammerbank 16 while at the same time allowing reciprocating movement of the hammerbank 16.

As previously noted, the cam drive assembly 20 has a cam which drives the hammerbank 16 in reciprocating fashion through a cam follower assembly. A portion of such a cam follower assembly 126 is shown in FIG. 3. The cam follower assembly 126 which is mounted on the end of the shaft length 48 of the hammerbank 16 extends beyond the shuttle base 18 at the right-hand end 106 of the shuttle assembly 14. The cam follower assembly 126 includes a roller bearing 127 which rides against the edge of the cam 41 driven by the fly wheel 40 of the cam drive assembly 20.

As previously described in connection with FIG. 2, various hammer springs 70 are selectively released by energizing the associated coil assemblies 88. Wire leads 126 for one of the coil assemblies 88 are shown in FIG. 2.

The various coil assemblies 88 for the sixty-six different hammer springs 70 are coupled to control circuitry external to the shuttle assembly 14. Such coupling is provided by many wire leads such as the wire leads 126 of FIG. 2 which are organized into six different wire buses 128 along the length of the hammerbank 16 as shown in FIG. 3. The wire buses 128 extend upwardly from the coil assemblies 88 and are clamped in place along the opposite side of the hammerbank 16 by clamping bars 130 and 132. The wire buses 128 which are shown broken off just below the clamping bars 130 and 132 in FIG. 3 eventually terminate in connectors which are secured to mating connectors within the printer 10 to complete coupling of the coil assemblies 88 to the control circuitry.

Figure 4:
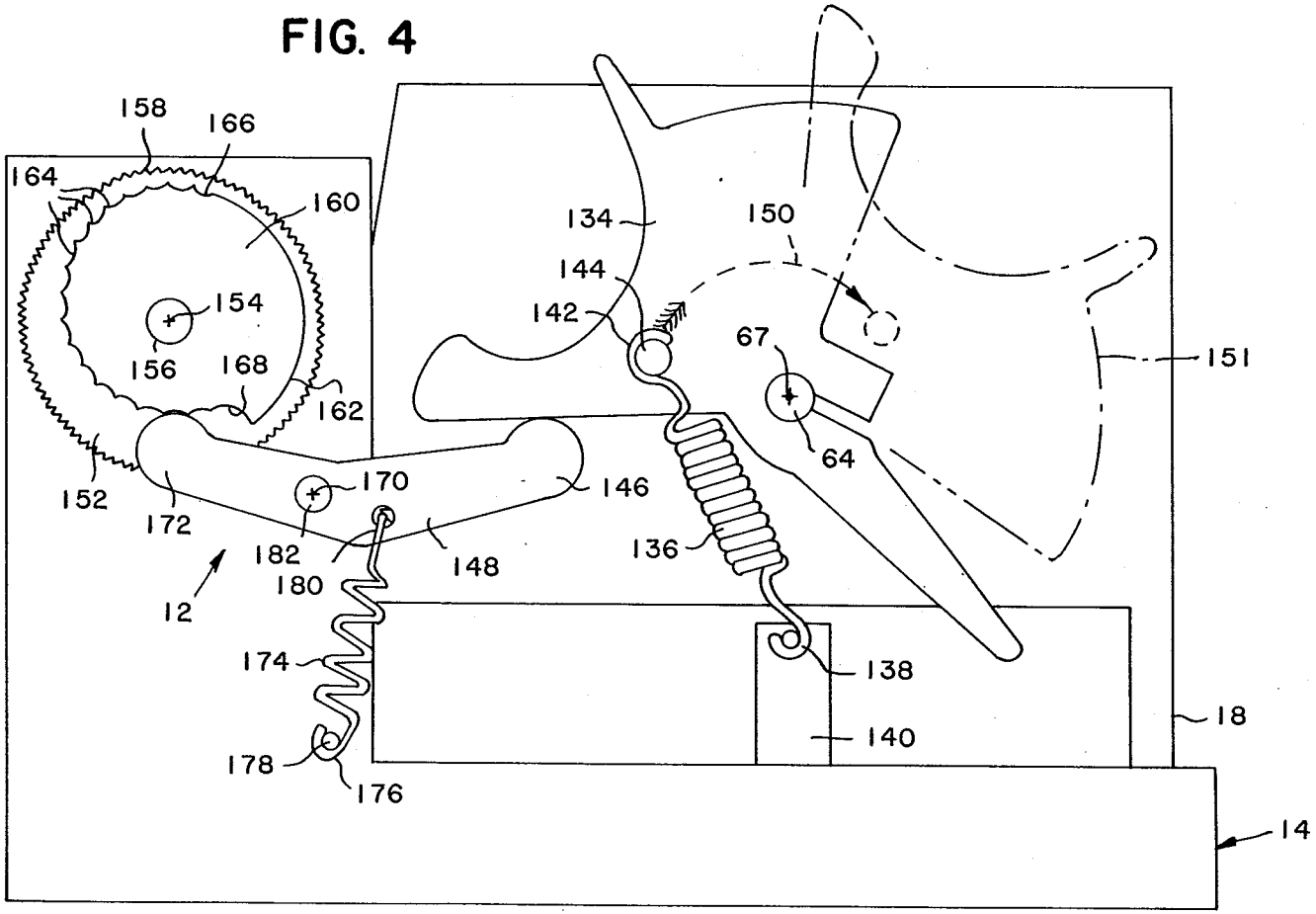
FIG. 4 is a left end view of the shuttle assembly of FIG. 3 illustrating the details of the resettable locking platen gap adjustment mechanism.

The resettable locking platen gap adjustment mechanism 12 which is shown in FIGS. 1 and 3 is shown in detail in FIG. 4. The mechanism 12 includes a platen handle 134 which is coupled to the platen 22 by being mounted on the shaft 64 which extends from one end of the platen 22. Rotation of the platen handle 134 provides rotation of the platen 22 and corresponding variation in the size of the platen gap 28.

An overcenter spring 136 in the form of a coil spring is coupled to the platen handle 134 to resiliently urge the platen handle 134 for rotation in one direction or the other. The overcenter spring 136 has a first end 138 thereof secured to a plate 140 attached to the shuttle base 18 and forming a fixed reference point on the printer 10. An opposite second end 142 of the overcenter spring 136 is coupled to the platen handle 134 at a location 144 thereof which is spaced-apart from the shaft 64, the common axis 67 of which defines the axis of rotation of the platen 22 and the platen handle 134. With the platen handle 134 in the position shown in solid outline in FIG. 4, the overcenter spring 136 biases the platen handle 134 for rotation in a counter-clockwise direction to maintain the platen handle 134 in contact with an end 146 of a platen handle stop lever 148. However, rotation of the platen handle 134 in a clockwise direction as viewed in FIG. 4 will eventually move the location 144 at which the second end 142 of the overcenter spring 136 is attached past the shaft 64 or "overcenter". When this occurs, the resiliency of the spring 136 biases the platen handle 134 for rotation in a clockwise direction as represented by an arrow 150. This results in rotation of the platen handle 134 into an open or paper load position which is shown by a dotted outline 151 in FIG. 4. With the platen handle 134 in the open or paper load position, the platen gap 28 is at its maximum size to facilitate loading or unloading of the print paper 30. After the print paper 30 is loaded, the platen handle 134 is rotated in the counter-clockwise direction until it rests against the end 146 of the platen handle stop lever 148.

The platen handle stop lever 148 forms a part of the locking platen gap adjustment mechanism 12 as does a knurled thumbknob 152. The knurled thumbknob 152 is mounted for rotation about an axis of rotation 154 which is parallel to the axis 67 about which the platen handle 134 and the platen 22 rotate. As seen in FIG. 3, the knurled thumbknob 152 is mounted for rotation about a shaft 156 which extends from a rear portion of the shuttle base 18 of the shuttle assembly 14 at the left-hand end 104 thereof. The knurled thumbknob 152 has a knurled circumferential surface 158 thereof which facilitates manual grasping and turning of the knurled thumbknob 152.

The knurled thumbknob 152 has a detented cam 160 attached to the side thereof. The detented cam 160 has an outer circumferential surface 162 comprised of a succession of scalloped detents 164 which vary progressively in their distance from the axis of rotation 154 to present a radially varying or eccentric configuration. The scalloped detents 164 begin with a detent 166 having the greatest distance from the axis of rotation 154 and progress around the outer circumferential surface 162 of the cam 160 to a detent 168 which is at the smallest distance from the axis of rotation 154.

The platen handle stop lever 148 which is of elongated configuration and which is pivotally mounted for rotation about a pivot axis 170 has an end 172 thereof opposite the end 146 for disposition within one of the detents 164 in the outer circumferential surface 162 of the cam 160. The platen handle stop lever 148 is rotatably biased about the pivot axis 170 in a direction to seat and lock the end 172 thereof within one of the detents 164 by a lever spring 174 in the form of a coil spring. The lever spring 174 has a first end 176 thereof coupled to a fixed reference point on the printer formed by a rod 178 extending outwardly from the left-hand end 104 of the shuttle base 18 of the shuttle assembly 14. An opposite second end 180 of the lever spring 174 is attached to the platen handle stop lever 148 at a location on the lever 148 between the end 146 thereof and the pivot axis 170. The platen handle stop lever 148 is mounted for pivoting movement about the pivot axis 170 by being rotatably disposed on a shaft 182 extending outwardly from a rear portion of the left-hand end 104 of the shuttle base 18 of the shuttle assembly 14.

The lever spring 174 continually biases the platen handle stop lever 148 for rotation in a clockwise direction as viewed in FIG. 4 to maintain the end 172 of the lever 148 seated within one of the detents 164 in the cam 160. At the same time, the overcenter spring 136 biases the platen handle 134 for rotation in a counter-clockwise direction as viewed in FIG. 4, except when the platen handle 134 is rotated into the open or paper load position, and this maintains the platen handle 134 in engagement with the end 146 of the lever 148. This combined action maintains the resettable locking platen gap adjustment mechanism 12 locked in a particular position until such time as the knurled thumbknob 152 is manually rotated to seat and lock the end 172 of the platen handle stop lever 148 in a different one of the detents 164. This positive, biased locking action insures that the platen gap 28 will not change due to vibration, paper drag or other potentially troublesome conditions. It also insures that a desired size for the platen gap 28 can be reestablished following a change of ribbon or other interruption by resetting the knurled thumbknob 152 to position the end 172 of the lever 148 in a selected one of the detents 164. When the end 172 of the lever 148 is seated within the detent 168 at one end of the outer circumferential surface 162 of the cam 160, the platen handle 134 is positioned to provide the platen gap 28 with its largest size apart from the open or paper load condition. As the knurled thumbknob 152 is rotated in a counter-clockwise direction as viewed in FIG. 4 to move the end 172 of the lever 148 over the detents 164 of increasing distance from the axis of rotation 154 to the detent 166 at the other end of the outer circumferential surface 162, the platen handle 134 is rotated so as to gradually reduce the platen gap 28 to its minimum size. Manual rotation of the knurled thumbknob 152 in a clockwise direction as viewed in FIG. 4 will again increase the size of the platen gap 28.

It will be understood by those skilled in the art that resettable locking platen gap adjustment mechanisms in accordance with the invention are applicable to other types of printers as well as the printer 10 described herein. For example, such a resettable locking platen gap adjustment mechanism could be used in the printer described in the previously referred to U.S. Pat. No. 3,941,051 of Barrus et al in which the shuttle assembly is of somewhat different configuration and a permanent part of the printer therein. Such a resettable locking platen gap adjustment mechanism could also be used in the printer described in U.S. Pat. No. 4,359,289 of Barrus et al which is commonly assigned with the present invention. In the printer described in U.S Pat. No. 4,359,289, the shuttle assembly is coupled to a band encircling a spaced-apart pair of rotatable pulleys so as to extend between the pulleys on one side thereof opposite an elongated counterbalance. The counter-balance acts as an armature for a linear motor which drives the counterbalance and the shuttle assembly in reciprocating fashion.

While there have been described above and illustrated in the drawings a number of variations, modifications and alternative forms, it will be appreciated that the scope of the invention defined by the appendant claims includes all forms comprehended thereby.

What is claimed is:

1. In a printer in which a plurality of hammers mounted along the length of an elongated hammerbank are selectively fired as the hammerbank is reciprocated relative to an elongated platen to impact a length of ink ribbon against at least one length of print paper supported by the platen to effect printing in dot matrix fashion, the platen being rotatable about an axis of rotation to vary the size of a gap between the plurality of hammers and the platen, an arrangement for selectively positioning the platen to provide the gap between the plurality of hammers and the platen with a desired size comprising means coupled to the platen for rotating the platen about the axis of rotation between an operative position and a paper load/unload position and means including a plurality of eccentrically disposed detents for resettably assuming one of a succession of predetermined positions, said means for resettably assuming engaging the means for rotating when the means for rotating is in the operative position.

2. In a printer in which a plurality of hammers mounted along the length of an elongated hammerbank are selectively fired as the hammerbank is reciprocated relative to an elongated platen to impact a length of ink ribbon against at least one length of print paper supported by the platen to effect printing in dot matrix fashion, the platen being rotatable about an axis of rotation to vary the size of a gap between the plurality of hammers and the platen, an arrangement for selectively positioning the platen to provide the gap between the plurality of hammers and the platen with a desired size comprising means coupled to the platen for rotating the platen about the axis of rotation and means for resettably locating the means for rotating the platen in any one of a succession of predetermined positions, the means for resettably locking including a member having a plurality of detents therein, the means for resettably locking further including a mechanism coupled to the means for rotating and resiliently biased into any one of the plurality of detents in the member, the means for rotating comprising a platen handle coupled to the platen, the means for resettably locking still further including a knob manually rotatable about an axis of rotation, the member having a plurality of detents therein comprising a cam mounted on the manually rotatable knob and having a succession of detents therein eccentrically disposed relative to the axis of rotation of the knob, and the mechanism resiliently biased into any one of the plurality of detents in the member comprising a pivotally mounted lever having a first end thereof engaging one of the detents of the cam and an opposite second end thereof engaging the platen handle.

3. The invention set forth in claim 2, wherein the mechanism resiliently biased into any one of the plurality of detents in the member further comprises a lever spring coupled between a fixed location on the printer and the lever and operative to resiliently bias the first end of the lever into one of the detents of the cam and the means for rotating further comprises an overcenter spring coupled between a fixed location on the printer and the platen handle and operative to resiliently bias the platen handle against the second end of the lever.

4. In a printer in which an elongated platen is rotated about an axis to vary a platen gap within the printer, a platen gap adjustment mechanism coupled to the platen and operative to positively lock the platen in any one of a succession of different positions about the axis, the platen gap adjustment mechanism including a first member having a succession of detents therein and a second member resiliently biased into one of the succession of detents in the first member and coupled to position the platen about the axis, the first member comprising a cam rotatable about an axis of rotation and having a succession of detents in an outer surface thereof eccentrically disposed relative to the axis of rotation.

5. The invention set forth in claim 4, wherein the platen gap adjustment mechanism includes a knurled thumbknob coupled to the cam.

6. The invention set forth in claim 4, wherein the second member comprises a pivotally mounted lever coupled to the printer via a spring and having a first portion thereof resiliently biased into one of the succession of detents in the first member and a second portion coupled to position the platen about the axis.

7. The invention set forth in claim 6, wherein the platen gap adjustment mechanism includes a platen handle coupled to the platen and engaging the second portion of the level and a spring coupled between the printer and the platen lever for biasing the platen handle against the second portion of the lever.

8. In a printer in which an elongated platen is rotatable about an axis to vary a platen gap within the printer, an arrangement for adjusting the platen gap comprising an adjustable mechanism having a movable member and operative to position the movable member at any one of a succession of different positions, a platen handle coupled to the platen and means for resiliently biasing the platen handle into contact with the movable member, the arrangement for adjusting the platen gap including a rotatable member having a succession of radially varying detents therein and means for resiliently biasing a portion of the movable member into any one of the succession of regularly varying detents in the rotatable member.

9. For use with a platen having a platen gap which varies with rotation of the platen, a resettable locking platen gap adjustment mechanism comprising a platen handle coupled to the platen and rotatable about a first axis of rotation, an overcenter spring coupled between a fixed mount and a location on the platen spaced-apart from the first axis of rotation, an elongated platen handle stop lever rotatable about a pivot axis and having a first end portion thereof engaging the platen handle and a second end portion on an opposite side of the pivot axis from the first end portion, a lever spring coupled between a fixed mount and a location on the lever between the pivot axis and the first end portion, a knurled thumbknob rotatable about a second axis of rotation, and a cam coupled to the knurled thumbknob and having an outer surface receiving the second end portion of the lever, the outer surface of the cam comprising a succession of detents which vary radially from the second axis of rotation.

* * * * *